US011371159B2

(12) United States Patent
Bergman et al.

(10) Patent No.: US 11,371,159 B2
(45) Date of Patent: Jun. 28, 2022

(54) METHODS OF REDUCING OR ELIMINATING DEPOSITS AFTER ELECTROCHEMICAL PLATING IN AN ELECTROPLATING PROCESSOR

(71) Applicant: APPLIED MATERIALS, INC., Santa Clara, CA (US)

(72) Inventors: Eric J Bergman, Kalispell, MT (US); Stuart Crane, Kalispell, MT (US); Tricia A Youngbull, Whitefish, MT (US); Timothy G Stolt, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 16/449,358

(22) Filed: Jun. 22, 2019

(65) Prior Publication Data

US 2020/0399779 A1 Dec. 24, 2020

(51) Int. Cl.

| | |
|---|---|
| ***C25D 21/08*** | (2006.01) |
| ***B08B 17/02*** | (2006.01) |
| ***B08B 3/08*** | (2006.01) |

(52) U.S. Cl.

CPC ..... *C25D 21/08* (2013.01); *B08B 3/08* (2013.01); *B08B 17/02* (2013.01)

(58) Field of Classification Search

CPC ..... C25D 21/08; B08B 17/02; B08B 3/08

See application file for complete search history.

(56) References Cited

U.S. PATENT DOCUMENTS

2003/0079683 A1* 5/2003 Nakano ..... H01L 21/76877 118/400
2009/0176022 A1* 7/2009 Shimizu ..... C23C 18/30 427/304
2012/0043217 A1* 2/2012 Arvin ..... C25F 7/00 205/261
2013/0291891 A1* 11/2013 Chuuman ..... H01L 21/02052 134/3
2014/0020720 A1* 1/2014 Fujikata ..... C25D 17/06 134/34

FOREIGN PATENT DOCUMENTS

JP 09279355 A * 10/1997
JP 2004183042 A * 7/2004
JP 2007169746 A * 7/2007

OTHER PUBLICATIONS

Machine translation: JP 2004-183042; Hirao, H. (Year: 2004).*
Machine translation: JP 2007-169746; Tanaka et al. (Year: 2007).*
JP09279355: Machine translation; Kuroda, T. (Year: 1997).*

* cited by examiner

*Primary Examiner* — Natasha N Campbell
(74) *Attorney, Agent, or Firm* — Kilpatrick Townsend & Stockton LLP

(57) ABSTRACT

Methods and apparatus for reducing the formation of insoluble deposits in semiconductor electrochemical plating equipment or a surface thereof during electrochemical plating, including: removing electrochemical plating equipment or a surface thereof from an electroplating solution, wherein residual electroplating solution is disposed atop the electrochemical plating equipment or a surface thereof, and wherein the residual electroplating solution has a first pH; contacting the residual electroplating solution with a rinse agent having a second pH similar to the first pH to form a rinsate; and removing the rinsate from the electrochemical plating equipment or a surface thereof.

16 Claims, 5 Drawing Sheets

METHODS OF REDUCING OR ELIMINATING DEPOSITS AFTER ELECTROCHEMICAL PLATING IN AN ELECTROPLATING PROCESSOR

FIELD

Embodiments of the present disclosure generally relate to methods of reducing or eliminating deposits after electrochemical plating in an electroplating processor by contacting surfaces in need thereof with a rinse agent having a predetermined pH suitable for maintaining solute solubility in a rinsate.

BACKGROUND

Microelectronic devices are generally formed on a semiconductor wafer or other type substrate or workpiece. In a typical manufacturing process, one or more thin metal layers are formed on a wafer to produce microelectronic devices and/or to provide conducting lines between devices.

The metal layers are generally applied to the wafers via electrochemical plating in an electroplating processor. A typical electroplating processor includes a vessel for holding an electrolyte or electroplating solution, one or more anodes in the vessel in contact with the electroplating solution, and a head having a contact ring with multiple electrical contact fingers that touch the wafer. The electrically conductive surface of the workpiece is immersed in the electroplating solution such as a bath of liquid electrolyte and an electrical contact causes metal ions in the electroplating solution to plate out onto the wafer, forming a metal layer or film. An electrical connection to the electrically conductive surface of the wafer may be made in an edge exclusion zone which is typically under 3 mm in width around the circumference of the wafer. Generally multiple electroplating processors are provided within an enclosure, along with other types of processors, to form an electroplating system.

The inventors have observed that multiple electroplating operations with multiple electroplating solutions and rinse chemistries such as deionized water problematically leads to the formation of contaminants such as organometallics, metallics, and the like in rinse solution or rinsate that plate-up or form scale upon device structures and surfaces such as a seal configured to keep the electroplating solution away from electrical contacts. Plate-up on the seal problematically leads to formation of a conductive path between the seal and contacts resulting in the plating of the contacts over desired substrate plating, as well as seal and contact failure.

The inventors have further observed that plate-up on the seal and/or electrical contacts on a contact ring require frequent maintenance for cleaning and/or depleting. The continuous need to maintain the contacts and the seal problematically reduces the throughput or use efficiency of the electroplating processor, as the electroplating processor is idle during the cleaning procedures.

Therefore, the inventors have provided improved embodiments of reducing or eliminated deposits after electrochemical plating in an electroplating processor.

SUMMARY

Methods and apparatus for reducing or eliminating the formation of conductive deposits on surfaces in electrochemical plating equipment are provided herein. In some embodiments, a method of reducing the formation of insoluble deposits in semiconductor electrochemical plating equipment or a surface thereof during electrochemical plating includes: removing electrochemical plating equipment or a surface thereof from an electroplating solution, wherein residual electroplating solution is disposed atop the electrochemical plating equipment or a surface thereof, and wherein the residual electroplating solution has a first pH; contacting the residual electroplating solution with a rinse agent having a second pH similar to the first pH to form a rinsate; and removing the rinsate from the electrochemical plating equipment or a surface thereof.

In some embodiments, a method of reducing or eliminating the formation of conductive deposits on surfaces in an electrochemical plating equipment includes contacting an acidic rinse agent with one or more surfaces including electrolyte to form an acidic rinsate; and flowing the acidic rinsate away from the one or more surfaces.

In another embodiment, a non-transitory computer readable medium having instructions stored thereon that, when executed, cause a method of for reducing or eliminating the formation of conductive deposits on surfaces in an electrochemical plating equipment, including removing electrochemical plating equipment or a surface thereof from an electroplating solution, wherein residual electroplating solution is disposed atop the electrochemical plating equipment or a surface thereof, and wherein the residual electroplating solution has a first pH; contacting the residual electroplating solution with a rinse agent having a second pH similar to the first pH to form a rinsate; and removing the rinsate from the electrochemical plating equipment or a surface thereof.

Other and further embodiments of the present disclosure are described below.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. However, the appended drawings illustrate only typical embodiments of the disclosure and are therefore not to be considered limiting of scope, for the disclosure may admit to other equally effective embodiments.

Figure 1:
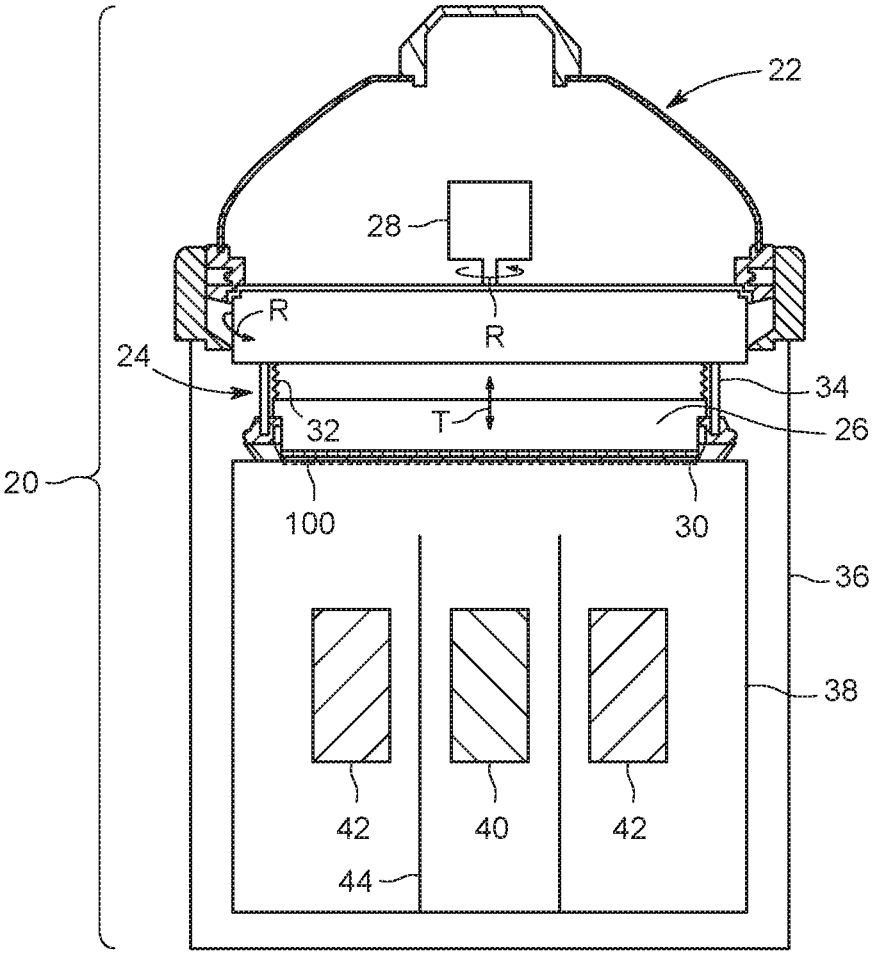
FIG. 1 schematically illustrates a cross-sectional view of an electroplating processor in accordance with some embodiments of the present disclosure.

To facilitate understanding, identical reference numerals have been used, where possible, to designate identical elements that are common to the figures. The figures are not drawn to scale and may be simplified for clarity. Elements and features of one embodiment may be beneficially incorporated in other embodiments without further recitation.

DETAILED DESCRIPTION

Methods and apparatus for reducing or eliminating the formation of deposits such as insoluble conductive deposits on surfaces in electrochemical plating equipment are provided herein. In embodiments, the present disclosure provides methods for reducing or even preventing the formation of insoluble material, deposits, or scale on equipment used in electrochemical plating deposition. According to methods of the present disclosure, the material forming the deposit can be maintained in solution by the action of a rinse agent having a predetermined pH suitable to prevent the formation of precipitates capable of forming into insoluble deposit or scale. In accordance with the present disclosure, as the material forming the deposit remains a solute or soluble material in solution such as a rinsate, the material forming the deposit can then be easily removed from the equipment or processing system, by standard methods or conventional means known to those of skill in the art.

In some embodiments, the method of the present disclosure includes reducing the formation of insoluble deposits during electrochemical plating. During electrochemical plating, the plating solutions produce acidic residues that interact with soluble metals in plating solutions to produce organometallic precipitates and metallic precipitates. The precipitates include insoluble solids and/or precursors that deposit as scale on processing equipment and problematically form conductive pathways through seals configured to contain the plating solution resulting in production interruptions. In an aspect, the solid deposit is formed from various metals and organic precursors in the electroplating solution. Non-limiting metals that may be included in the electroplating solutions include copper, tin, gold, nickel, silver, palladium, platinum, and rhodium, and alloys such as noble metal alloys, tin-copper, tin-silver, tin-silver-copper, tin-bismuth, permalloy and other nickel alloys, lead-tin alloys, and other lead-free alloys.

In some embodiments, a method of reducing or eliminating the formation of conductive deposits on surfaces in an electrochemical plating equipment includes contacting an acidic rinse agent with one or more surfaces including electrolyte to form an acidic rinsate; and flowing the acidic rinsate away from the one or more surfaces. The inventors have observed that avoiding deposits or plate-up advantageously maintains the life of the plating equipment including contacts or seals while eliminating scheduled down-time for cleaning. For example the inventors have observed that maintenance for cleaning and/or depleting on the seal and/or electrical contacts on a contact ring may be avoided by providing a rinse agent having a predetermined pH that is equal to or approximate the pH of the electrolyte or electroplating solution. By avoiding or reducing the need to maintain the contacts and the seal the throughput or use efficiency of the electroplating processor is increased, as the electroplating processor does not have to idle during cleaning procedures. The inventors have observed that by providing a rinse agent with a pH similar to the pH of the electroplating solution or electrolyte, precipitation of contaminants or problematic species that promote plate-up on surfaces within the electrochemical plating equipment is avoided or reduced as the contaminants or problematic species flow away from the surfaces of the electrochemical plating equipment upon rinse.

In embodiments, metal features in a semiconductor device such as an interconnect may be formed in an electrochemical deposition (ECD) system. Non-limiting examples of ECD systems include tools designed to electrochemically deposit metals such as one available from Applied Materials Inc. under the trademarks NOKOTA™ECD, RAIDER®ECD, or as described in U.S. Pat. No. 7,198,694 entitled Integrated tool with interchangeable Wet Processing Components for Processing Microfeature Workpieces and Automated Calibration Systems to Woodruff, et al. assigned to Semitool Inc. of Kalispell, M T.

In some non-limiting examples, metal deposition may occur in an electroplating processor that supports a substrate during electroplating, which may be part of an ECD system such as those available from Applied Materials, Inc. of Santa Clara, Calif., or the electroplating processor may be a processor such as those described in U.S. Pat. No. 10,113,245 to Wilson entitled Electroplating Contact Ring with Radially Offset Contact Fingers and assigned to Applied Materials Inc. Other processing chambers, including those available from other manufacturers, may also be adapted to benefit from the present disclosure.

Referring now to FIG. 1, a non-limiting example of an electroplating processor 20 is shown including a head 22 and a rotor 24. In embodiments, a motor 28 in head 22 rotates the rotor 24 in a predetermined direction around an axis, as indicated by the arrow R in FIG. 1. In embodiments, contact ring 30 such as an annular contact ring on or attachable to the rotor 24 makes electrical contact with a wafer 100 held into or onto the rotor 24. In some embodiments, the rotor 24 may include a backing plate 26, and ring actuators 34 for moving the contact ring 30 vertically (in the direction T in FIG. 1) between a wafer load/unload position and a processing position. In embodiments, the head 22 may include bellows 32 to allow for vertical or axial movement of the contact ring 30 while sealing internal head components from process liquids and vapors.

In some embodiments, the head 22 is engaged onto a frame 36. A vessel or bowl 38 within the frame 36 holds electroplating solution such as a bath of liquid electrolyte. The bath supply includes a source of metal ion(s) to be deposited on the surface of a workpiece. The metal or metals to be plated onto the workpiece or wafer 100 such as a substrate in accordance with the methods described herein are present in an electroplating solution as species of metal ions to be deposited onto the workpiece. In embodiments, the metal ions are deposited under process conditions that preferentially deposit metal ions into recessed features as opposed to the surrounding field surfaces. In some embodiments, head 22 is movable to position a wafer 100 held in the rotor 24 into contact with electroplating solution such as a bath of liquid electrolyte in the bowl 38.

In embodiments, one or more electrodes are positioned in the bowl. For example, the bowl may include a center electrode 40 and a single outer electrode 42 surrounding and concentric with the center electrode 40. In embodiments, the center electrode 40 and single outer electrode 42 may be provided in a dielectric material field shaping unit 44 to set up a desired electric field and current flow paths within the electroplating processor 20. Various numbers, types and configurations of electrodes may be used. The electrode is in electrical contact with the electroplating solution. The power supply supplies electroplating power between the surface of the workpiece and the electrode which promotes the electroplating of electroplate metal ions onto the surface. The controller controls the supply of electroplating power so that the metal ions are deposited on the workpiece surface.

Figure 2:
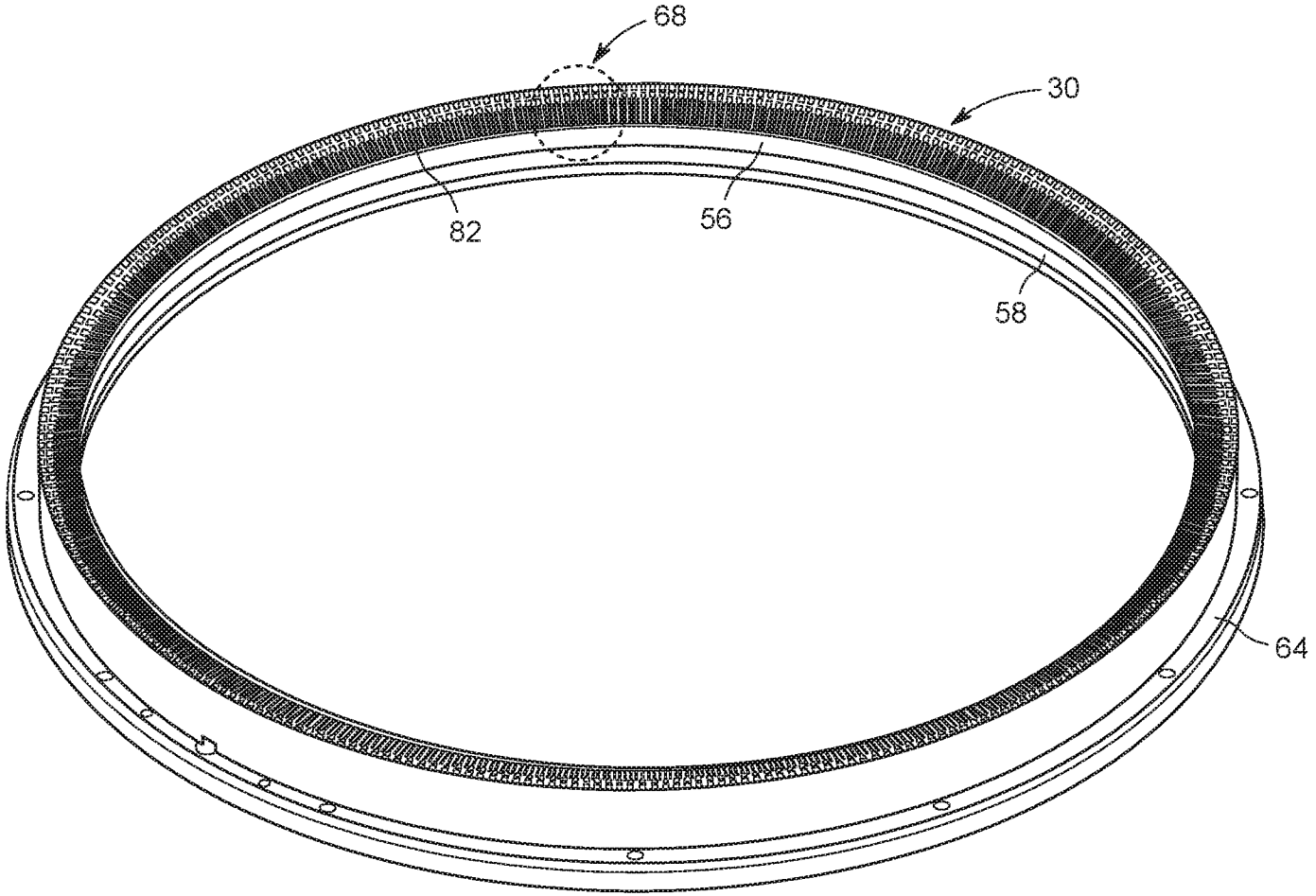
FIG. 2 is a perspective view of the contact ring shown in FIG. 1.

Referring now to FIG. 2 a contact ring 30 is shown separated from the rotor 24 and inverted. Accordingly, the contact fingers collectively referenced as 82 on the contact ring 30, which are shown at or near the top of the contact ring 30 in FIG. 2, are at or near the bottom end of the contact ring 30 when the contact ring 30 is installed into the rotor 24. A mounting flange 64 may be provided on the contact ring for attaching the contact ring 30 to the rotor 24 with fasteners. In embodiments, contact fingers 82 may be provided on straight strips 68 of stamped metal, for ease of manufacture, with the strips 68 attached to the base ring 50 (FIG. 3) and/or the outer shield ring 52. The contact fingers 82 may be flat and rectangular, and equally spaced apart from each other. The contact ring 30 may have 300 to 1000 contact fingers, with typical designs using 360 or 720 contact fingers.

Figure 3:
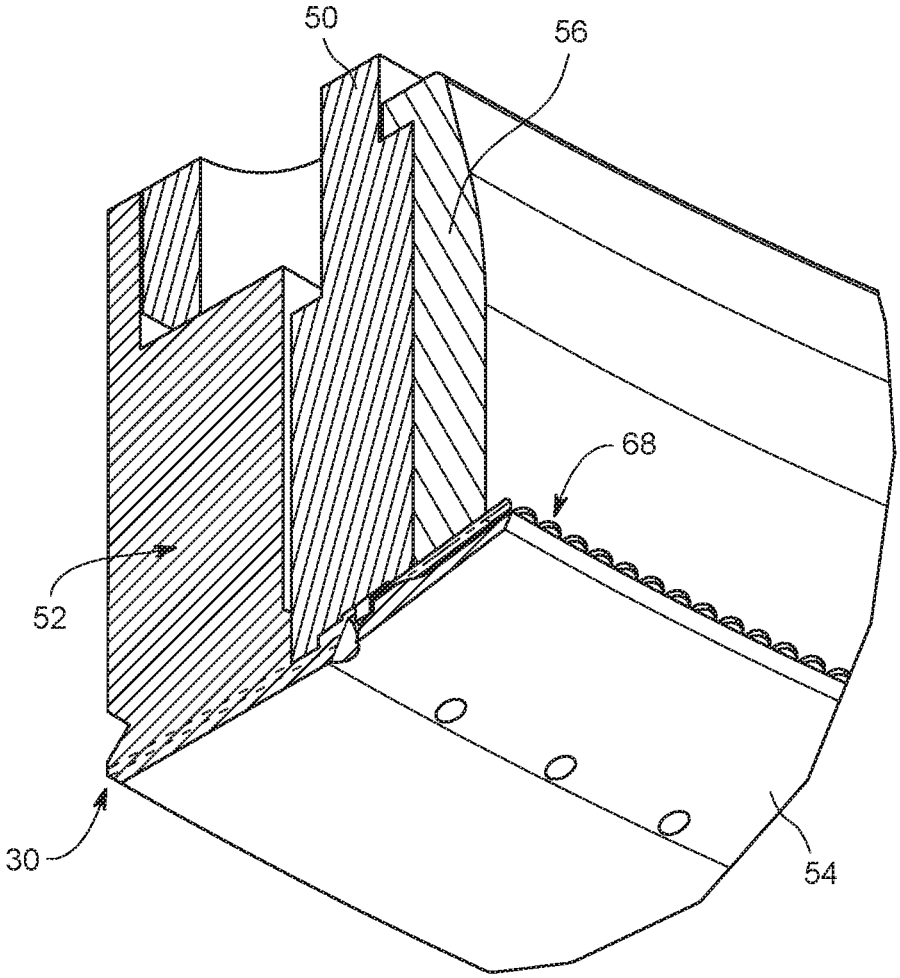
FIG. 3 is a perspective view of a portion of the contact ring of FIG. 2.

Referring now to FIG. 3, a section view of the contact ring 30 is shown, with the contact ring in the installed upright orientation shown in FIG. 1. As depicted in FIG. 3, the contact ring 30 has a base ring 50 between an inner liner 56 and an outer shield ring 52. In embodiments, a shield 54, if used, covers part of or the entire length of contact fingers 82. The contact fingers 82 are electrically connected to the processor electrical system via wiring and/or a base ring 50 such as a conductive base ring, and via a connector on the contact ring 30 or on the head. In embodiments, the contact fingers may be provided on straight strips or other configurations such as those shown in U.S. Pat. No. 10,113,245 described above.

Figure 4:
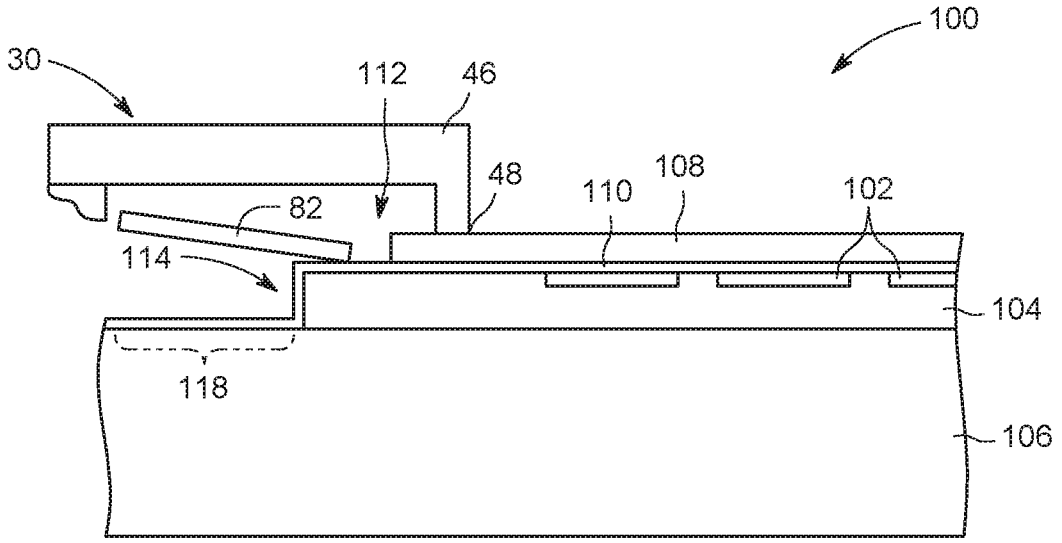
FIG. 4 schematically illustrates a cross-sectional view of a processor of FIG. 1 processing a wafer.

Referring now to FIG. 4, a schematic cross-sectional side view of a wafer 100 such as a reconstituted wafer having individual chips or dies 102 embedded in a layer of molding compound or epoxy 104 on a glass, plastic, ceramic or substrate 106 such as a silicon substrate is shown. In embodiments, a photoresist layer 108 is disposed atop and covers a seed layer 110 such as a metal seed layer, except at the edge exclusion zone 112. In embodiments, the seed layer 110 is applied onto the sidewall or bevel at the edge of the molding compound or epoxy 104 and onto the edge of the substrate 106, forming a seed layer step generally shown at 114.

Still referring to FIG. 4, a contact finger 82 is shown contacting the seed layer 110 at the edge exclusion zone 112, which is located above the layer of molding compound or epoxy 104 and radially outside of the photoresist layer 108. In embodiments, contact ring 30 includes a seal 46 such as an annular seal overlying the contact fingers and configured to prevent the electroplating solution such as from a bath of electrolyte from contacting the contact fingers 82. The seal 46 has an annular sealing surface or edge 48 adapted to seal against a wafer 100, or, in embodiments, as shown in FIG. 4 against the photoresist layer 108 on the wafer 100, and with all contact fingers radially outside of the annular sealing surface. In embodiments, the methods of the present disclosure prevent insoluble deposits from forming on seal 46 and surfaces thereof such as edge 48, and other surfaces that contact both the electroplating solution such as from a bath of electrolyte and rinse agent in accordance with the present disclosure. In embodiments, the methods of the present disclosure prevent insoluble deposits from forming on seal 46 and surfaces thereof such as edge 48 and maintain the life of the seal such that electroplating solution from a bath of electrolyte does not contact fingers 82 over the life of the seal 46.

Still referring to FIG. 4, the width of the edge exclusion zone 112 (on top of the step 114) is influenced by the positioning and concentricity of the photoresist layer 108 and the molding compound or epoxy 104, and may vary by the type of wafer 100 or reconstituted wafer involved. Generally, the edge exclusion zone is up to 3.0 mm wide. The seed layer extension 118 on the substrate 106 radially outside of the layer of molding compound or epoxy 104, shown in dotted lines in FIG. 4, is a contingent landing area because the seed layer 110 may not maintain continuity over the step 114. During electroprocessing a wafer having an electrically conductive edge exclusion zone may be placed into an electroprocessor having a contact ring having a plurality of contact fingers. A front side of the wafer may be moved into engagement with one or more contact fingers, with the contact fingers contacting the front side of the wafer in the edge exclusion zone, and the front side of the wafer may be placed into contact with an electroplating solution or electrolyte. Electric current may be conducted through the electroplating solution, the edge exclusion zone and one or more contact fingers. Metal ions in the electrolyte deposit out onto the conductive edge exclusion zone and other areas electrically connected to the conductive edge exclusion zone, forming a metal layer on the wafer.

In embodiments, after the metal is deposited, the electrochemical plating equipment or one or more surfaces thereof, such as those shown in wafer 100, are removed from the electroplating solution and rinsed by contacting with a rinse agent having a pH similar to the pH of the electroplating solution. By using rinse agent with a preselected pH, embodiments of the present disclosure maintain contaminants in solution in the rinsate or mixture formed including the rinse agent and any residual electroplating solution disposed atop the electrochemical plating equipment or a surface thereof. In some embodiments, the pH of the residual electroplating solution can be measured according to known techniques, such as use of a pH meter in a 20 degree Celsius solution, to obtain a first pH value, and the pH of the rinse agent may be predetermined or measured to obtain a second pH value, which may be the same as the first pH value or different. In embodiments, the pH meter is calibrated as known in the art. In embodiments, the pH of the residual electroplating solution and pH of the rinse agent may be a value between 2 and 4.5. In embodiments, the pH of the residual electroplating solution and pH of the rinse agent may be similar such as, for example, within a pH value of plus or minus 2, 1, 0.5, or 0.2 to 2.0. In some embodiments, the pH of the residual electroplating solution may be about 3, and the pH of the rinse agent may be about 5. In some embodiments, the pH of the residual electroplating solution may be about 3.5, and the pH of the rinse agent may be about 3.5 to 4.5. In some embodiments, the pH of the residual electroplating solution may be about 4, and the pH of the rinse agent may be about 4. In some embodiments, the pH of the electroplating solution may be below 1, and the pH of the rinse agent may be about 2 for the purpose of suppressing plate-up.

In some embodiments, the rinse agent has a preselected pH. For example, the pH of the rinse agent may be equal or similar to the pH of the electroplating solution. Preselecting a pH may include preselecting a type of rinse agent. In embodiments, the rinse agent is a mineral acid, such as an acid derived from an inorganic compound. Non-limiting examples of suitable mineral acids include hydrogen bromide (BrH), hydrogen iodide (HI), hydrochloric acid (HCl), nitric acid ($HNO_3$), nitrous acid ($HNO_2$), phosphoric acid ($H_3PO_4$), sulfuric acid ($H_2SO_4$), boric acid ($H_3BO_3$), hydrofluoric acid (HF), hydrobromic acid (HBr), perchloric acid ($HClO_4$), hydroiodic acid (HI), and combinations thereof. In embodiments, organic acids such as alkylsulfonic acids, e.g, methane sulfonic acid (MSA) is a suitable rinse agent in accordance with the present disclosure. In embodiments, organic acids provide pH control as described herein, but also act as chelating agents sufficient for bonding with species in solution which, if not chelated, may promote the formation of plate-up films. In some embodiments, MSA may include 1M MSA, and may be diluted in water 50:1. In some embodiments suitable methane sulfonic acid for use herein includes methane sulfonic acid having a molar concentration in the range of 0.02 M to 1M and a pH in the range of 2 to 4.5. In embodiments, for example where the electroplating solution includes a tin-silver plating bath with a pH of around 3, a 0.04M solution of MSA with a pH of about 3.5 is sufficient to preventing plate-up after several thousand plating cycles e.g., greater than 2500 plating cycles.

In embodiments, the rinse agent comprises or consists of methane sulfonic acid. For example methane sulfonic acid (pH of about 2 and a concentration of approximately 20 g/L methane sulfonic acid (MSA) in water) may be provided in an amount sufficient to prevent the formation of a precursor layer and/or subsequent plate-up. In one embodiment, methane sulfonic acid is a suitable rinse agent for use in accordance with the present disclosure, wherein the methane sulfonic acid has a concentration of at least 3.6 g/L and solution thereof has a pH of about 3. In embodiments, the rinse agent such as methane sulfonic acid (MSA) is contacted with a surface in need thereof for 10 seconds or more, or a duration sufficient to displace the bulk of the plating chemistry from the surface being cleaned.

In some embodiments, the rinse agent is an acid solution comprising carbonic acid ($H_2CO_3$). In embodiments, carbonic acid is applied as a rinse agent, wherein the pH of the rinse agent is similar or somewhat higher than the pH of the electroplating solution or electrolyte. In embodiments, a carbonic acid rinse agent is formed by dissolving carbon dioxide in water and under pressure to achieve a pH between about 3 and 4. In embodiments, carbon dioxide may also be injected directly in water to form carbonic acid or may be pressurized on one side of a permeable membrane with water on the other side of the membrane. Such systems are commercially available and are often known as gas contactors. Gas diffuses through the barrier and dissolves in the water, thereby forming carbonic acid. In embodiments, carbonic acid is provided in amounts sufficient and under conditions suitable for preventing the formation of plate-up precursors and subsequent plate-up. In embodiments, for example where the electroplating solution includes a tin-silver plating bath with a pH of around 3, a concentration of carbonic acid resulting in a pH of about 3 to 4 is suitable to prevent plate-up when used to rinse the tin-silver plating bath. In embodiments, a concentration of carbonic acid resulting in a pH of about 3 to 4 is sufficient to prevent plate-up when used to rinse the tin-silver plating bath after several thousand plating cycles e.g., greater than 3000 plating cycles.

In embodiments, the rinse agent is electrolyzed water such as cathode water having a pH of 4.5 to 2.7. By using the cathode water at reduced pH to rinse surfaces which have been exposed to electroplating solutions and chemistries, constituents of the electroplating solution and/or plating bath remain in solution and do not deposit on the surfaces, creating the plate-up precursor film and eventual plate-up. In some embodiments, such as where an alkali electroplating solution or bath, anode water may be used in a similar manner. In such embodiments, rinse agent and the electroplating solution may have a substantially similar pH within the range of, e.g., 8-10.

In embodiments, a pH adjusting agent may be included to obtain a preselected pH of a rinse agent. For example, a pH adjusting agent can be added to a rinse agent of the present disclosure. In embodiments, pH adjusting agents may be provided in any amount necessary to obtain a desired pH value in the final composition of the rinse agent. Acidic pH adjusting agents can be organic acids, including amino acids, and inorganic mineral acids. Non-limiting examples of acidic pH adjusting agents include acetic acid, citric acid, fumaric acid, glutamic acid, glycolic acid, hydrochloric acid, lactic acid, nitric acid, phosphoric acid, sodium bisulfate, sulfuric acid, and the like, and combinations thereof. In embodiments, all organic acids are contemplated for use as pH adjusting agents. Non-limiting examples of alkaline pH adjusting agents include alkali metal hydroxides, such as sodium hydroxide, and potassium hydroxide; ammonium hydroxide; organic bases; and alkali metal salts of inorganic acids, such as sodium borate (borax), sodium phosphate, sodium pyrophosphate, and the like, and mixtures thereof.

Figure 5:
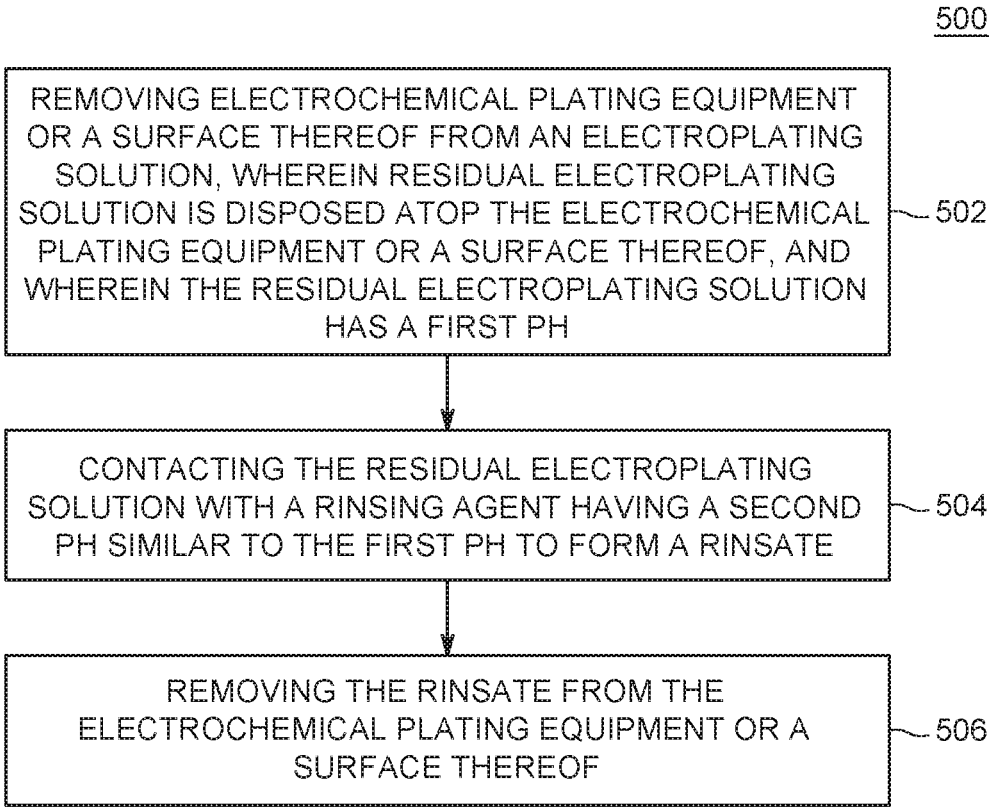
FIG. 5 is a process flow of a method in accordance with the present disclosure.

Referring now to FIG. 5, the methods of the present disclosure include method 500 of reducing the formation of insoluble deposits in semiconductor electrochemical plating equipment or a surface thereof during electrochemical plating. In embodiments, the methods include, as shown in block 502, removing electrochemical plating equipment or a surface thereof from an electroplating solution, wherein residual electroplating solution is disposed atop the electrochemical plating equipment or a surface thereof. In embodiments, the residual electroplating solution has a first pH. In embodiments, semiconductor electrochemical plating equipment includes the wafer 100, seal 46 and edge 48 as shown in FIG. 4 removed from an electroplating solution, wherein residual electroplating solution is disposed atop the seal 46 and edge 48. In embodiments, the methods include, as shown in block 504, contacting the residual electroplating solution with a rinse agent having a second pH similar to the first pH to form a rinsate. For example, where seal 46 and edge 48 as shown in FIG. 4 include residual electroplating solution disposed thereon after removal from an electroplating solution, the residual electroplating solution may be contacted with rinse agent having a second pH similar to the first pH to form a rinsate. In embodiments, the methods include, as shown in block 506, removing the rinsate from the electrochemical plating equipment or a surface thereof. In embodiments, the first pH is substantially similar to the second pH. In embodiments, the first pH is equal to the second pH. In embodiments, the first pH is 2 to 5, and the second pH is 2 to 5. In embodiments, the first pH is 3 to 4.5, and the second pH is 3 to 4.5. In embodiments, the first pH is 8 to 10, and the second pH is 8 to 10. In embodiments, the rinse agent is a mineral acid. In embodiments, the rinse agent is a carbonic acid. In embodiments, the rinse agent is applied under conditions sufficient to prevent precipitation of organometallic or metallic precursors from the rinsate. In some embodiments, the rinse agent is applied under conditions that maintain the pH of the residual electroplating solution. In some embodiments, contacting the rinse agent with the residual electroplating solution causes a reduction of the formation of insoluble deposits in semiconductor electrochemical plating equipment or a surface thereof. In some embodiments, the surface is disposed upon a seal such as seal 46.

Figure 6:
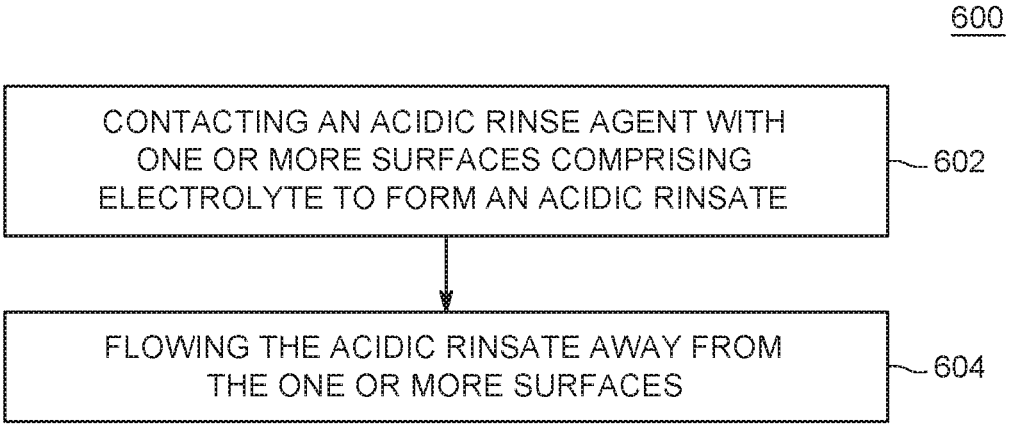
FIG. 6 is a process flow of a method in accordance with the present disclosure.

Referring now to FIG. 6, the methods of the present disclosure include method 600 of reducing or eliminating the formation of conductive deposits on surfaces in an electrochemical plating equipment, including, at 602, contacting an acidic rinse agent with one or more surfaces including electrolyte to form an acidic rinsate, and at 604, flowing the acidic rinsate away from the one or more surfaces. In embodiments, the electrolyte has a first pH that is substantially similar to the acidic rinse agent. In embodiments, the electrolyte has a first pH equal to the acidic rinse agent. In embodiments, electrolyte has a pH of 2 to 5, and the acidic rinse agent has a pH of 2 to 5. In embodiments, the electrolyte ha a pH of 3 to 4.5, and the acidic rinse agent pH of 3 to 4.5. In some embodiments, the acidic rinse agent is a mineral acid. In some embodiments, the acidic rinse agent is carbonic acid. In some embodiments, the acidic rinse agent is applied under conditions sufficient to prevent precipitation of organometallic or metallic precursors from the acidic rinsate. In some embodiments, the acidic rinse agent is applied under conditions that maintain the pH of the electrolyte. In some embodiments, contacting the acidic rinse agent with the electrolyte causes a reduction of the formation of insoluble deposits in semiconductor electrochemical plating equipment or a surface thereof. In embodiments, the surface is disposed upon a seal.

Figure 7:
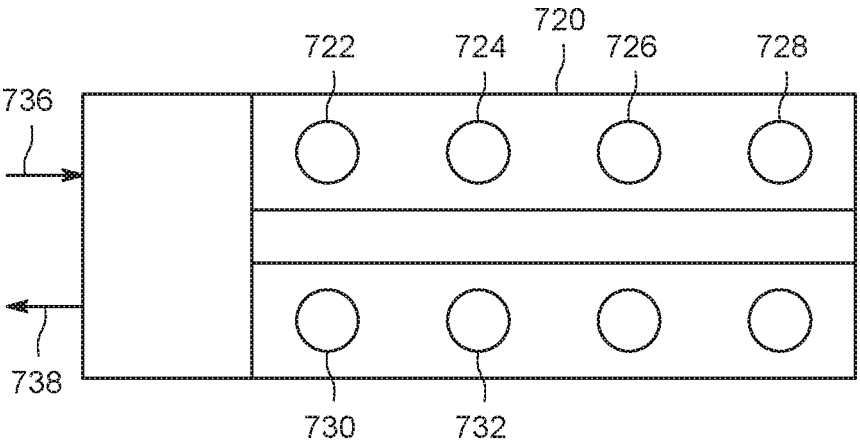
FIG. 7 is a schematic illustration of a tool for carrying out processes for forming features described herein.

Referring now to FIG. 7, and integrated tool can be provided to carry out a number of process steps involved in the formation of microfeatures on wafers. Below is described one possible combination of processing stations that could be embodied in a processing tool platform sold under the trademark RAIDER® by Applied Materials, Inc. of Santa Clara, Calif. Other processing tool platforms could be configured in similar or different manners to carry out metallization steps such as those described below. Referring to FIG. 7, an exemplary integrated processing tool such as tool 720 includes stations to carry out a pre-wet process 722, optional metal such as copper deposition process 724, under bump metallization process 726, rinse process 728, alloy deposition process 730, and a spin-rinse-dry process 732. The chambers for carrying out such process sequences can be arranged in various configurations. Microelectronic workpieces are transferred between the chambers through the use of robotics (not shown). The robotics for the tool 720 are designed to move along a linear track. Alternatively, the robotics can be centrally mounted and designed to rotate to access the input section 736 and the output section 738 of tool 720. Processing tool such as tool 720 is capable of being programmed to implement user entered processing recipes and conditions.

The rinse chamber or station for rinse process 728 and spin-rinse-dry chamber or station for spin-rinse-dry process 732 may include the rinse agent as described herein and can be of the type available from numerous manufacturers for carrying out such process steps. Examples of such chambers include spray processing modules and immersion processing modules available in conjunction with the RAIDER®ECD system. The optional metal such as copper deposition chamber for optional copper deposition process 724, under bump metallization chamber for under bump metallization process 726 and metal alloy deposition chamber alloy for alloy deposition process 730 can be provided by numerous electroplating and electroless deposition chambers such as those available as immersion processing modules and electroplating processing reactors for the RAIDER®ECD system.

In some embodiments, the present disclosure relates to a non-transitory computer readable medium having instructions stored thereon that, when executed, cause a method for reducing or eliminating the formation of conductive deposits on surfaces in an electrochemical plating equipment, including removing electrochemical plating equipment or a surface thereof from an electroplating solution, wherein residual electroplating solution is disposed atop the electrochemical plating equipment or a surface thereof, and wherein the residual electroplating solution has a first pH; contacting the residual electroplating solution with a rinse agent having a second pH similar to the first pH to form a rinsate; and removing the rinsate from the electrochemical plating equipment or a surface thereof.

In some embodiments, the present disclosure relates to a non-transitory computer readable medium having instructions stored thereon that, when executed, cause a method of reducing or eliminating the formation of conductive deposits on surfaces in an electrochemical plating equipment, including contacting an acidic rinse agent with one or more surfaces comprising electrolyte to form an acidic rinsate; flowing the acidic rinsate away from the one or more surfaces.

In some embodiments, the present disclosure relates to a process to prevent metal plate-up on the seal surfaces of an electrochemical plating system used for the manufacture of semiconductor devices including applying an acidic rinse agent to remove the bulk of the plating chemistry from surfaces exposed to electroplating bath. In some embodiments, the rinse agent is one or more of the mineral acids, including sulfuric acid, nitric acid and hydrochloric acid, as well organic acids and carbonic acid. In some embodiments, the present disclosure includes use of rinse agents such as acids produced at or near the point of use, for example, by mixing carbon dioxide with water or injecting carbon dioxide into a process stream for mixture with water or other rinse agent. In embodiments, a gas such as hydrogen chloride gas may be used as the rinse agent. In embodiments, the present disclosure includes the use of electrolyzed water (cathode water) having a reduced pH to achieve the desired purpose of preventing deposits from an acidic plating bath. In some embodiments, anode water, having an elevated pH, may be used for the same purpose in the case of an alkali plating bath.

In some embodiments, the present disclosure relates to a method of reducing the formation of insoluble deposits in semiconductor electrochemical plating equipment or a surface thereof during electrochemical plating. In embodiments, the methods include: removing electrochemical plating equipment or a surface thereof from an electroplating solution, wherein residual electroplating solution is disposed atop the electrochemical plating equipment by contacting the residual electroplating solution with an aqueous rinse agent which has been modified by the addition of chemical additives selected to prevent the deposition of organics, organometallic and metallic compounds on the surfaces of the electrochemical plating equipment. Non-limiting examples of chemical additives include pH adjusting agents, one or more organic acids, one or more mineral acids, and combinations thereof.

In some embodiments, the present disclosure relates to a method of removing residual electroplating solution disposed atop electrochemical plating equipment, wherein the residual electroplating solution has a first pH by contacting the residual electroplating solution with a rinse agent having a second pH similar to the first pH to form a rinsate; and removing the rinsate from the electrochemical plating equipment or a surface thereof. In some embodiments, the first pH is substantially similar to the second pH. In some embodiments, the first pH is equal to the second pH. In some embodiments, the first pH is 2 to 5, and the second pH is 2 to 5. In some embodiments, the rinse agent is a mineral acid. In embodiments, the rinse agent is carbonic acid. In embodiments, the rinse agent is applied under conditions sufficient to prevent precipitation of organometallic or metallic precursors from the rinsate. In some embodiments, subsequent to the application of rinse agent in accordance with the present disclosure, water such as DI water may be supplied in an additional rinse process.

In some embodiments, use of rinse agent in accordance with the present disclosure may be accompanied by sonic, ultrasound, or mechanical energy to improve or enhance cleaning of surfaces in need thereof.

While the foregoing is directed to embodiments of the present disclosure, other and further embodiments of the disclosure may be devised without departing from the basic scope thereof.

The invention claimed is:

1. A method of reducing the formation of insoluble deposits in semiconductor electrochemical plating equipment or a surface thereof during electrochemical plating, the method comprising:

removing electrochemical plating equipment or a surface thereof from an electroplating solution, wherein residual electroplating solution is disposed atop the electrochemical plating equipment or a surface thereof, and wherein the residual electroplating solution has a first pH;

contacting the residual electroplating solution with a rinse agent having a second pH similar to the first pH to form a rinsate, wherein the rinse agent is a mineral acid; and removing the rinsate from the electrochemical plating equipment or a surface thereof.

2. The method of claim 1, wherein the first pH is substantially similar to the second pH.

3. The method of claim 1, wherein the first pH is equal to the second pH.

4. The method of claim 1, wherein the first pH is 2 to 5, and the second pH is 2 to 5.

5. The method of claim 1, wherein the first pH is 8 to 10, and the second pH is 8 to 10.

6. The method of claim 1, wherein the rinse agent is applied under conditions sufficient to prevent precipitation of organometallic or metallic precursors from the rinsate.

7. The method of claim 1, wherein the rinse agent is applied under conditions that maintain the pH of the residual electroplating solution.

8. The method of claim 1, wherein contacting the rinse agent with the residual electroplating solution causes a reduction of the formation of insoluble deposits in semiconductor electrochemical plating equipment or a surface thereof.

9. The method of claim 1, wherein the surface is disposed upon a seal.

10. A method of reducing or eliminating the formation of conductive deposits on surfaces in an electrochemical plating equipment, comprising contacting an acidic rinse agent with one or more surfaces comprising electrolyte to form an acidic rinsate; and flowing the acidic rinsate away from the one or more surfaces, wherein the electrolyte has a first pH substantially similar to the acidic rinse agent, wherein the electrolyte has a pH of 2 to 5, and the acidic rinse agent has a pH of 2 to 5, and wherein the acidic rinse agent is a mineral acid.

11. The method of claim 10, wherein the electrolyte has a first pH equal to the acidic rinse agent.

12. The method of claim 10, wherein the acidic rinse agent comprises carbonic acid.

13. The method of claim 10, wherein the acidic rinse agent is applied under conditions sufficient to prevent precipitation of organometallic or metallic precursors from the acidic rinsate.

14. The method of claim 10, wherein the acidic rinse agent is applied under conditions that maintain the pH of the electrolyte.

15. The method of claim 10, wherein contacting the acidic rinse agent with the electrolyte causes a reduction of the formation of insoluble deposits in semiconductor electrochemical plating equipment or a surface thereof.

16. The method of claim 15, wherein the surface is disposed upon a seal.

* * * * *